United States Patent [19]

Marey

[11] Patent Number: 4,514,141

[45] Date of Patent: Apr. 30, 1985

[54] SAFETY STOP FOR A VARIABLE SETTING STATOR BLADE PIVOT

[75] Inventor: Daniel J. Marey, Paris, France

[73] Assignee: S.N.E.C.M.A., Paris, France

[21] Appl. No.: 482,940

[22] Filed: Apr. 7, 1983

[30] Foreign Application Priority Data

Apr. 8, 1982 [FR] France ..... 82 06117

[51] Int. Cl.[3] ..... F01B 25/02

[52] U.S. Cl. ..... 415/160

[58] Field of Search ..... 415/9, 148, 146, 147, 415/156, 160, 161, 162, 163, 164; 74/526

[56] References Cited

U.S. PATENT DOCUMENTS

| | | | |
|---|---|---|---|
| 1,570.536 | 1/1926 | Syvertsen | 415/164 X |
| 3,029,067 | 4/1962 | Parker et al. | 415/9 |
| 3,107,546 | 10/1963 | Rowland | 74/526 |
| 3,295,827 | 1/1967 | Chapman | 415/161 U X |
| 3,303,992 | 2/1967 | Johnson | 415/149 |
| 3,360,241 | 12/1967 | Lindquist | 415/160 |
| 3,367,628 | 2/1968 | Fitton | 415/110 |

FOREIGN PATENT DOCUMENTS

| | | | |
|---|---|---|---|
| 556572 | 10/1957 | Belgium . | |
| 1047538 | 12/1958 | Fed. Rep. of Germany . | |
| 1041161 | 10/1953 | France . | |
| 1281702 | 2/1961 | France | 415/160 |
| 621175 | 4/1949 | United Kingdom . | |

*Primary Examiner*—Abraham Hershkovitz
*Assistant Examiner*—Joseph M. Pitko
*Attorney, Agent, or Firm*—Oblon, Fisher, Spivak, McClelland & Maier

[57] ABSTRACT

The device consists of an arm having structure for attachment to the bottom pivot of a stator blade. Stopping elements are provided in the inner stator ring against which the arm can come to rest. The stopping elements consist of the sides of a circumferential notch formed in the inner surface of the inner ring. A C-shaped molding fastened onto the inner ring makes the notch leak-proof.

5 Claims, 5 Drawing Figures

SAFETY STOP FOR A VARIABLE SETTING STATOR BLADE PIVOT

BACKGROUND OF THE INVENTION

1. Field of the Invention

The present invention relates to a safety stop for a variable setting stator vane pivot in which the blade is equipped with top and bottom pivots, and in which the top pivot, which works within a bearing set in the engine housing, is controlled by an orientation system while the bottom pivot moves within a bearing set in an inner ring of the engine.

2. Description of the Prior Art

The adjustability of the orientation of stator in the various compressor stages is particularly desirable when one wishes to attain, for example, the greatest possible pressure while retaining a sufficient surging margin for the various stages at a given speed. As a result, the vanes of one or more compression stages have at least one pivot mounted in a bearing and capable of being operated by an operating system. If a mechanical connector, e.g., a pin joining two successive levers of the operating system, or a pin connecting one of these levers to a stationary element such as the housing, should fail to fulfill its connecting function for whatever reason (e.g., breakage or loss following disengagement of a retaining screw), there may occur either a sudden flapping of the blades, resulting in the probable surging of the entire stage, or a sustained floating of the vanes, resulting in the nearly certain breakage of one of the vanes and destruction of the succeeding rotor stages, and possibly even more serious secondary damage.

An example of variable setting stator blades is found in French Pat. No. 2,205,952 in which the preliminary compression stage and four upper compression stages are equipped with adjustable stator blades. The pivots at the top of these blades are operated by a system of rings and levers which, using a single control, changes the orientation of the vanes of each stage in question. The stator of the preliminary compression stage has blades of a relatively large size equipped with a bottom pivot capable of absorbing deflecting stress.

SUMMARY OF THE INVENTION

The present invention is intended to minimize the problems resulting from a break in the linkage and is adapted particularly to variable setting stator vanes operated at the top but also having a bottom pivot.

The invention consists of a cam arm including structure for fixing to the bottom pivot, and stop means provided in the inner stator ring, against which the arm can come to rest.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
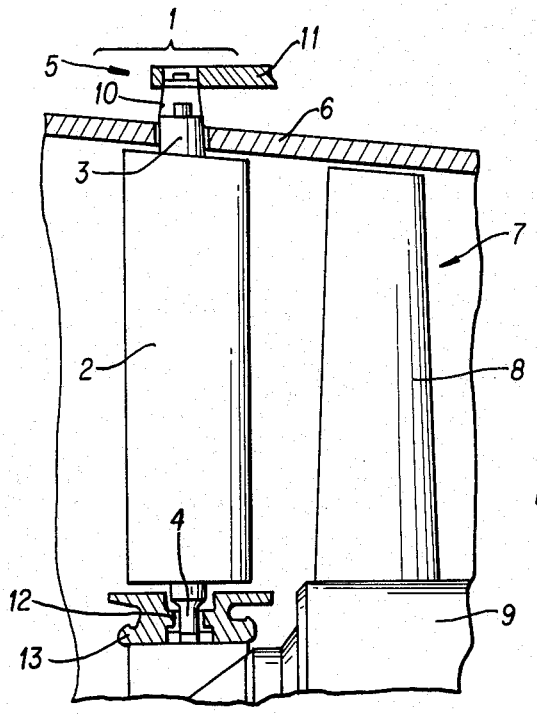
FIG. 1 shows the arrangement of a top-operated twin-pivot stator vane.

FIG. 1 shows in partial section a part of a compressor stage including a stator 1 formed by a ring of vanes 2, each vane having top and bottom pivots 3 and 4 whose orientation is operated from the top by a linkage 5 located outside engine housing 6. A rotor 7 is formed by vanes 8, the bases of which are set into rotor disk 9.

Top pivot 3 turns in a bearing set in the upper ring of housing 6. One of the ends of a control rod or lever 10 is fixed to pivot 3, while the other end is fixed to link 11 for operating the ring of vanes.

The safety stop of the invention (FIGS. 2, 3 and 5) consists of at least one arm 14 including attachment means for becoming fixed to pivot 4, and stop elements 15 and 16 fixed to inner ring 13 to block the rotation of arm 14 in case the control mechanism (e.g., 10 and 11) breaks.

Figure 2:
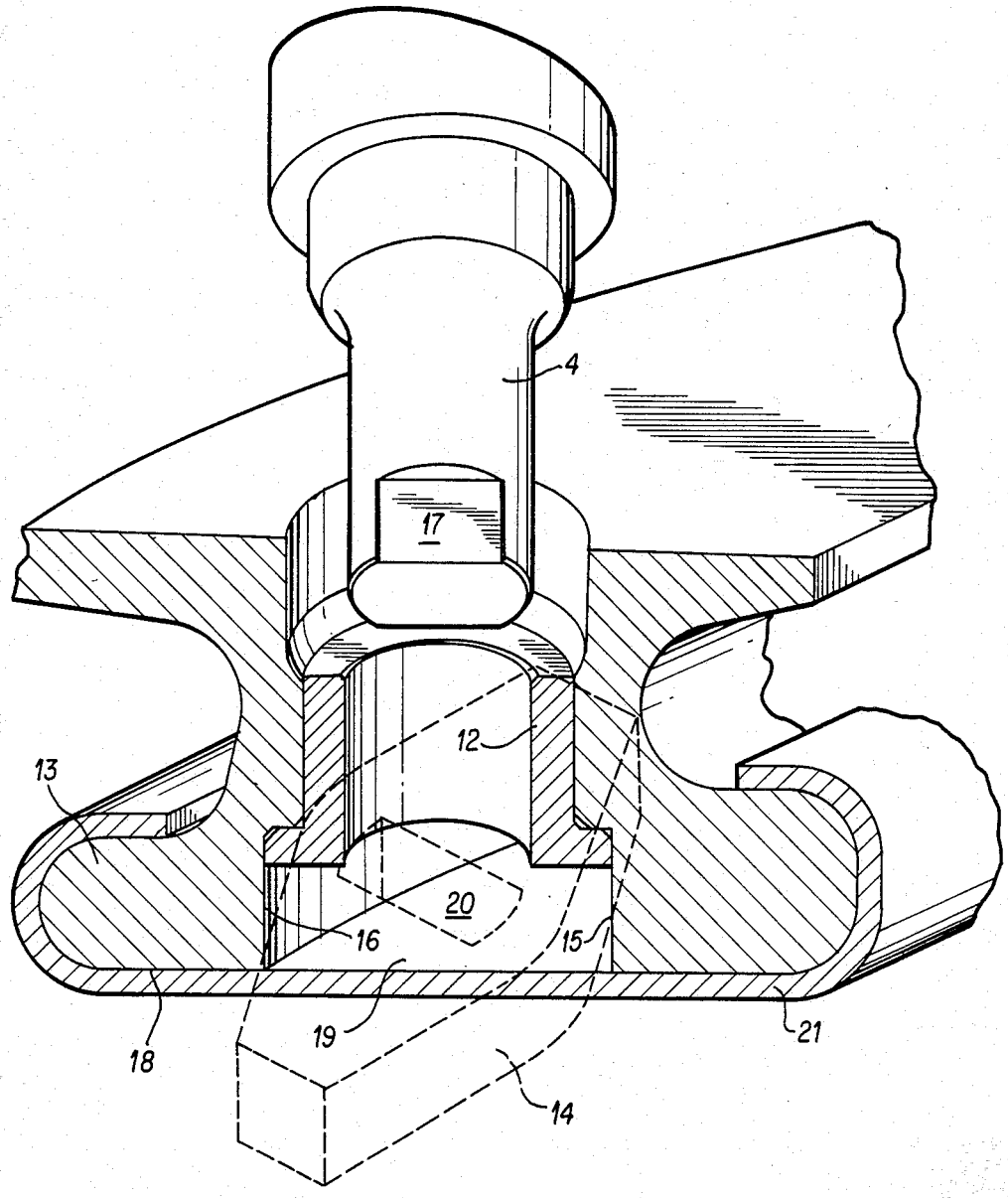
FIG. 2 is an exploded view in perspective and in partial section of a pivot including the stop means of the first embodiment of the invention.
Figure 3:
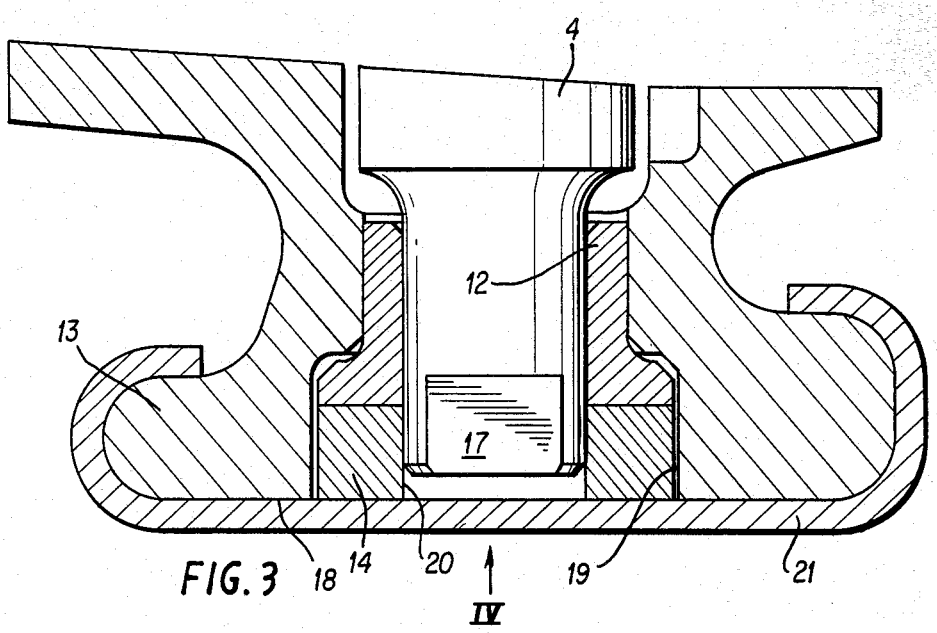
FIG. 3 is a longitudinal section of a pivot equipped with the arrangement according to the first embodiment of the invention.
Figure 4:
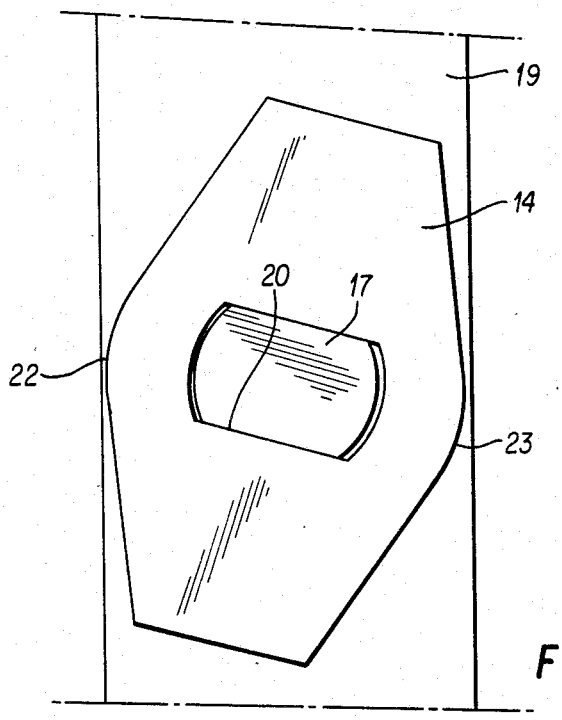
FIG. 4 is a view along line IV of FIG. 3, but without piece 21.

According to the embodiment shown in FIGS. 2, 3 and 4, the end of cylindrical pivot 4 at the vane root has at least one, and preferentially two, parallel flattened surfaces 17.

Pivot 4 is held within a bearing 12 consisting of a bushing of self-lubricating material fixed within inner stator ring 13 of the compressor stage. The radially inner surface 18 of this stator ring 13 is provided with a circumferentially extending notch 19 into which projects the end of pivot 4, particularly the portion bearing flattened surfaces 17. The arm 14 is fastened to the end of the pivot 4 by the attachment means composed of a rectangular central hole 20 with two opposing curved ends corresponding to the shape of the end of the pivot 4 so that the pivot can fit therein. When viewed flat (FIG. 4), arm 14 is pill shaped with the two rounded peaks 22 and 23 that lie along a line parallel to the flat sides of the hole 20 and passing through the center of the arm 14. The length of this line is less than the width of notch 19. The angles of the arm are set so as to allow the orientation of the vanes to be adjusted within a given angular range. In case of breakage of the operating elements, the ends of the opposing sides of the arm will abut the stop means formed by sides 15 and 16 of notch 19 to limit rotation of the arm.

In order to ensure that channel 19 will remain leak tight and/or that the arm will be securely held in the ring 13, an annular piece 21, e.g., a C-shaped piece, is fastened by any known means onto lower stator ring 13.

Figure 5:
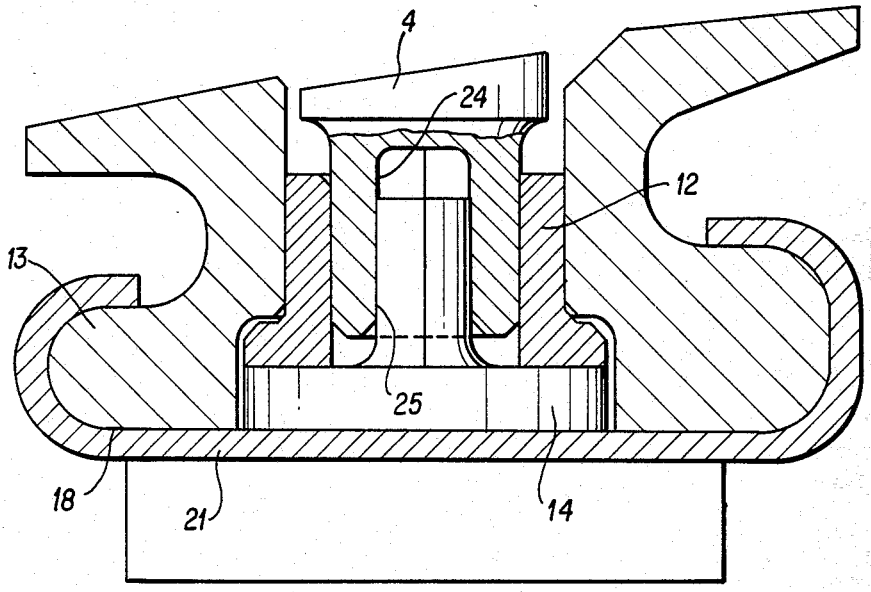
FIG. 5 is a longitudinal section of a pivot equipped with the arrangement according to a second embodiment of the invention.

In a second embodiment shown in FIG. 5, the spindle of bottom pivot 4 contains a hexagonal hole 24 with one opening, into which is inserted a nipple 25 of comparable size and shape and extending perpendicular to the plane of arm 14, of which the nipple forms an integral part. An annular C-shaped molding 21 is attached to the inner stator ring 13 to ensure a proper seal and, possibly, to support the arm 14 against the pivot.

In other equivalent embodiments that have not been shown:

1. The arm may be shaped like a isoceles triangle corresponding to a truncated part of the arm disclosed above and having at the middle of its base structure by which it can become fixed to the end of the pivot.

2. The arm may be rectangular, with attachment structure provided at the center or at one end of the rectangle.

3. Stop elements 15 and 16 may consist, for one or more arms, of the walls of a recess into which the end of the pivot enters.

In case of a break of linkage, the vane may swivel suddenly under the effect of aerodynamic forces until the ends of arm 14 come up against the walls of recess or channel 19 of the ring 13.

Besides the advantages of eliminating the surging of the stage and breaking of vanes, the limiting of the degree of possible accidental play of the vane allows limiting of the overall length of the engine. Since the vanes can no longer behave like a sail and "turn into the wind," it becomes possible to reduce the length of the engine by 5 mm per stage, leading to a significant reduction in mass.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A safety stop for a variable setting stator vane, said vane having top and bottom pivots, said top pivot being monitored by blade orientation means, said bottom pivot being set in a bearing of a stator ring, said safety stop comprising:

a cam arm having at least one cam portion;

means for securing said cam arm onto said bottom pivot;

stop elements associated with said stator ring, said cam arm and stop elements being constructed and arranged such that said rotation of said stator vane beyond a predetermined angular range causes contact between said cam portion and said stop elements so as to limit rotation of said stator blade, wherein said stator ring includes a recess into which said bottom pivot extends, wherein said cam arm is located in said recess, and wherein said stop elements comprise lateral walls of said recess, wherein said recess comprises a circumferential channel in a radially inner wall of said stator ring; and an element fixed to said radially inner wall of said stator ring and covering said channel.

2. The safety stop of claim 1 wherein said cam arm is pill shaped, and wherein said means for securing extend from the center of said cam arm.

3. The safety stop of claim 1 wherein said cam arm is in the form of an isoceles triangle, and wherein said means for securing extend from the middle of the base of said triangle.

4. The safety stop of claim 1 wherein said means for securing comprise:

a rectangular hole in said cam arm, said hole having two curved sides; and said end of said bottom pivot shaped to fit said hole and being inserted in said hole.

5. The safety stop of claim 1 wherein said means for securing comprise:

a hexagonal bore in said bottom pivot, and a nipple fixed to said cam arm, said nipple shaped to fit said bore and inserted in said bore.

* * * * *